US011123981B2

(12) United States Patent
Martin et al.

(10) Patent No.: US 11,123,981 B2
(45) Date of Patent: Sep. 21, 2021

(54) PRINTHEAD NOZZLE ADDRESSING

(71) Applicant: HEWLETT-PACKARD DEVELOPMENT COMPANY, L.P., Spring, TX (US)

(72) Inventors: Eric T. Martin, Corvallis, OR (US); Chris Bakker, Corvallis, OR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/778,197

(22) Filed: Jan. 31, 2020

(65) Prior Publication Data

US 2020/0164639 A1 May 28, 2020

Related U.S. Application Data

(62) Division of application No. 15/525,119, filed as application No. PCT/US2014/068074 on Dec. 2, 2014, now Pat. No. 10,562,296.

(51) Int. Cl.
*B41J 2/045* (2006.01)
*B41J 2/14* (2006.01)

(52) U.S. Cl.
CPC ..... *B41J 2/04541* (2013.01); *B41J 2/0455* (2013.01); *B41J 2/0458* (2013.01); *B41J 2/04581* (2013.01); *B41J 2/1404* (2013.01); *B41J 2/14056* (2013.01); *B41J 2/14112* (2013.01); *B41J 2002/14338* (2013.01); *B41J 2002/14467* (2013.01); *B41J 2202/12* (2013.01); *B41J 2202/13* (2013.01)

(58) Field of Classification Search
None
See application file for complete search history.

(56) References Cited

U.S. PATENT DOCUMENTS

| | | | | |
|---|---|---|---|---|
| 4,968,363 | A | 11/1990 | Hashimoto | |
| 5,644,342 | A | 7/1997 | Argyres | |
| 6,224,184 | B1 | 5/2001 | Imanaka | |
| 6,471,324 | B1 | 10/2002 | Maru | |
| 6,478,396 | B1 | 11/2002 | Schloeman et al. | |
| 6,742,868 | B2 * | 6/2004 | Usuda | B41J 2/04543 347/15 |
| 7,578,951 | B2 | 8/2009 | Dunfield et al. | |

(Continued)

FOREIGN PATENT DOCUMENTS

| | | |
|---|---|---|
| EP | 0 816 110 | 1/1998 |
| WO | WO2013154586 | 10/2013 |

OTHER PUBLICATIONS

Next-generation Inkjet Printhead Drive Electronics—Publicaiton date: Jun. 1997—Author: Rice H. W.: http://www.hpl.hp.com/hpjournal/97jun/jun97a5.pdf (6 pages).

*Primary Examiner* — Shelby L Fidler
(74) *Attorney, Agent, or Firm* — Trop Pruner & Hu PC

(57) ABSTRACT

Fluid ejection devices with multiple activation modes are disclosed. An example printhead assembly includes a fluid ejection nozzle, a first resistor fluidically coupled to the fluid ejection nozzle, and a second resistor fluidically coupled to the fluid ejection nozzle. The example printhead also includes an addressing circuit to receive a nozzle address and an activation mode to activate the fluid ejection nozzle. The activation mode determines which of the first resistor and the second resistor are to be energized.

19 Claims, 7 Drawing Sheets

300

300

(56) References Cited

U.S. PATENT DOCUMENTS

| | | | |
|---|---|---|---|
| 7,996,597 | B1 | 8/2011 | Venkatramani et al. |
| 2005/0088465 | A1 | 4/2005 | Parish et al. |
| 2005/0168511 | A1 | 8/2005 | Hu |
| 2005/0225578 | A1 | 10/2005 | Hu et al. |
| 2010/0165053 | A1 | 7/2010 | Bergstedt et al. |
| 2010/0244932 | A1 | 9/2010 | Lane et al. |
| 2013/0155135 | A1 | 6/2013 | Govyadinov et al. |

* cited by examiner

300

300

400

500

PRINTHEAD NOZZLE ADDRESSING

CROSS REFERENCE TO RELATED APPLICATIONS

This is a divisional of U.S. application Ser. No. 15/525,119, having a national entry date of May 8, 2017, which is a national stage application under 35 U.S.C. § 371 of PCT/US2014/068074, filed Dec. 2, 2014, which are both hereby incorporated by reference in their entirety.

BACKGROUND

Today's printers generally use a fluid delivery system that includes some form of printhead. The printhead holds a reservoir of fluid, such as ink, along with circuitry that enables the fluid to be ejected onto a print medium through nozzles. Some printheads are configured to be easily refilled, while others are intended for disposal after a single-use. The printhead usually is inserted into a carriage of a printer such that electrical contacts on the printhead couple to electrical outputs from the printer. Electrical control signals from the printer activate the nozzles to eject fluid and control which nozzles are activated and the timing of the activation. A substantial amount of circuitry may be included in the printhead to enable control signals from the printer to be properly processed.

BRIEF DESCRIPTION OF THE DRAWINGS

Certain examples are described in the following detailed description and in reference to the drawings, in which.

DETAILED DESCRIPTION OF SPECIFIC EXAMPLES

This disclosure describes techniques for dynamic dual-FET control of a printhead nozzle. In most printheads, each nozzle is associated with a single, addressable transistor that activates the nozzle by energizing a heating element such as a resistor. Each nozzle has a single activation mode and a single level of energy that is used to energize the heating element. The printhead disclosed herein enables multiple activation modes for each printhead nozzle. To enable multiple activation modes, each nozzle is associated with at least two drive transistors. The printhead also includes an addressing circuit that enables the print system to dynamically control which of two transistors fire or whether both transistor fire at the same time. The ability to engage multiple nozzle activation modes enables various new printhead capabilities, some of which are discussed further below, including a boost mode and a simultaneous micro-recirculation mode.

Figure 1:
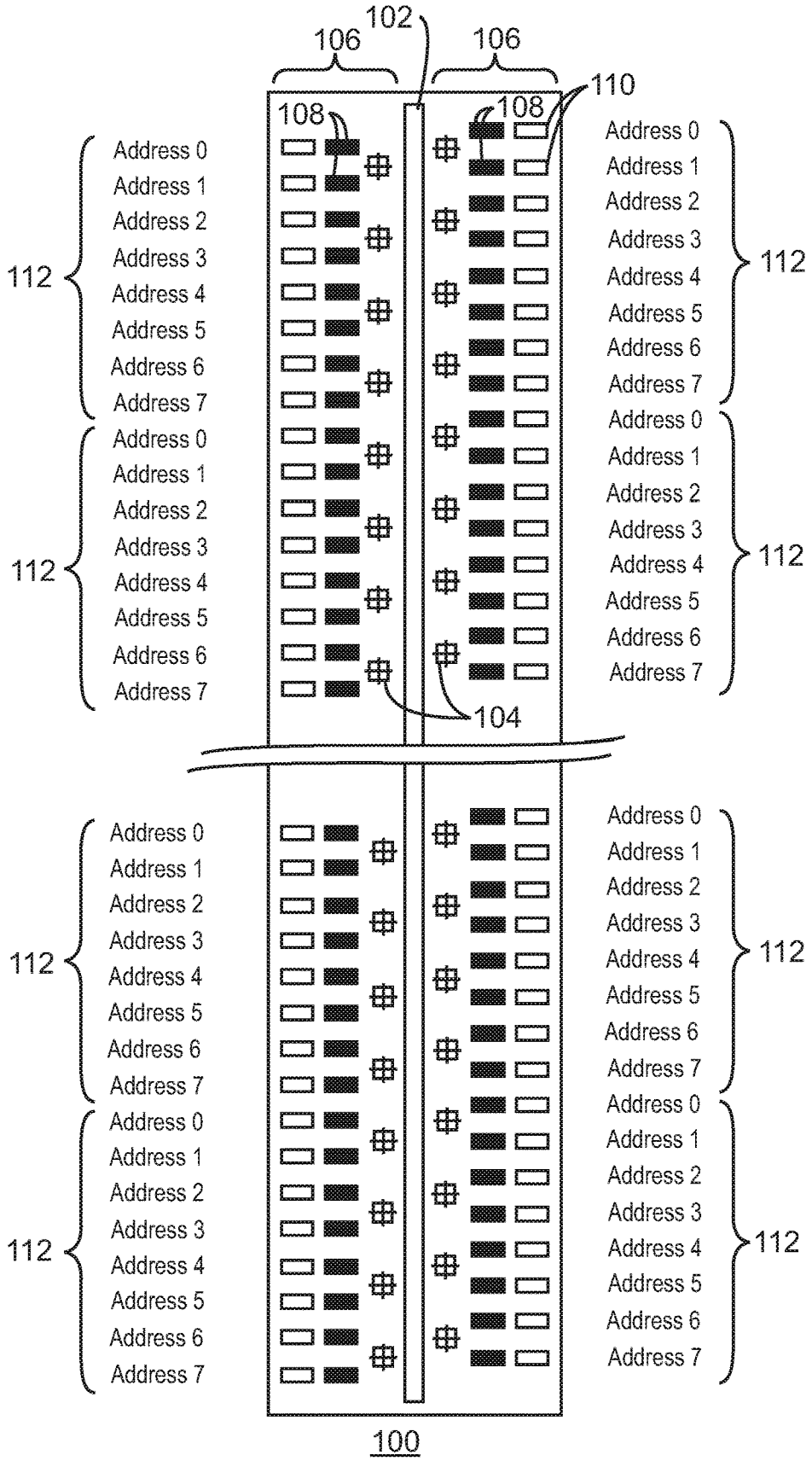
FIG. 1 is a diagram of the bottom surface of an example printhead.

FIG. 1 is a diagram of the bottom surface of an example printhead. The printhead is generally referred to by the reference number 100. The printhead 100 of FIG. 1 includes a fluid feed slot 102 and two columns of nozzles 104, referred to as nozzle columns 106. During use, fluid is drawn from the fluid feed slot 102 and ejected from the nozzles 104 onto a print medium. The fluid may be ink, a material used in three-dimensional printing such as a thermoplastic or photopolymer, or other suitable fluid.

Each nozzle 104 may be part of a fluid chamber that includes two energy delivery devices. The energy delivery devices are referred to herein as resistors 108. However, other types of energy delivery devices may also be used to activate the nozzles 104. Other non-limiting examples of energy delivery devices are a piezo electric material that deforms in response to an applied voltage or a paddle made of a multi-layer thin film stack that deforms in response to a temperature gradient. Each resistor 108 is electrically coupled to the output of at a drive transistor 110, which provides the current to the resistor 108, causing the resistor 108 to generate heat. A selected nozzle 104 can be activated by turning on one or both of the corresponding drive transistors 110, which heats the fluid in contact with or adjacent to the resistor 108 and thereby causes the fluid to be ejected from the nozzle 104. In some examples, the current is delivered to the resistor 108 in a series of pulses. The drive transistors 110 can be any suitable type of transistors, including Field Effect Transistors (FET), and others.

The printhead 100 can include any suitable number of nozzles 104. Furthermore, although two nozzle columns 106 are shown, the printhead 100 can include any suitable number of nozzle columns. For example, the printhead 100 can include additional fluid feed slots 102 with corresponding nozzle columns 106 on each side of each fluid feed slot 102. If multiple fluid feed slots 102 are included, each fluid feed slot 102 may be configured to deliver a different type of fluid, such as a different color ink or a different material.

The nozzles 110 may be divided into groups referred to herein as primitives 112. Each primitive 112 can include any suitable number of nozzles 104. In some examples, only one nozzle per primitive is fired at any given time. This may be, for example, to manage peak energy demands. To activate specific nozzles 104, the printer sends data to the printhead, which the printhead circuitry processes to determine which drive nozzles 104 are being targeted and the activation mode. Part of the information received from the printer is address information. Each drive transistor 110 within a primitive 112 corresponds with a different address, which is unique within that primitive 112. The addresses are repeated for each primitive 112. In the example printhead 100 of FIG. 1, the first nozzle 104 in the upper left corner of the printhead 100 is controlled by two transistors 110, one of which corresponds to address zero and one of which corresponds with address 1.

In some examples, two resistors 108 are included in a same fluid chamber. The selection of the resistor 108 to be energized enables the use of different activation energies for a single nozzle 104. For example, in a boost mode configuration, the printer may be able to select different activation energies for the nozzles 104 by selectively addressing the appropriate drive transistors 110. In normal operation, only one of the resistors 108, referred to as a main resistor, is energized. In a boost mode, both the main resistor and a boost resistor are energized simultaneously, thus increasing the thermal energy delivered to the fluid in the chamber. The print system can dynamically transition between normal mode and boost mode. The boost mode operation may be useful, for example, to clear nozzles of dry ink or to enable the use of inks with a higher ink drop weight. One example of an addressing circuit that enables the use of a boost mode is discussed further below in relation to FIGS. 3A and 3B.

It will be appreciated that the printhead of FIG. 1 is one example of a printhead 100 that can be manufactured in accordance with the techniques described herein and that several variations may be possible within the scope of the claims. Furthermore, the printheads described can be used in two-dimensional printing, three-dimensional printing and other applications besides printing, such as digital titration, among others.

Figure 2:
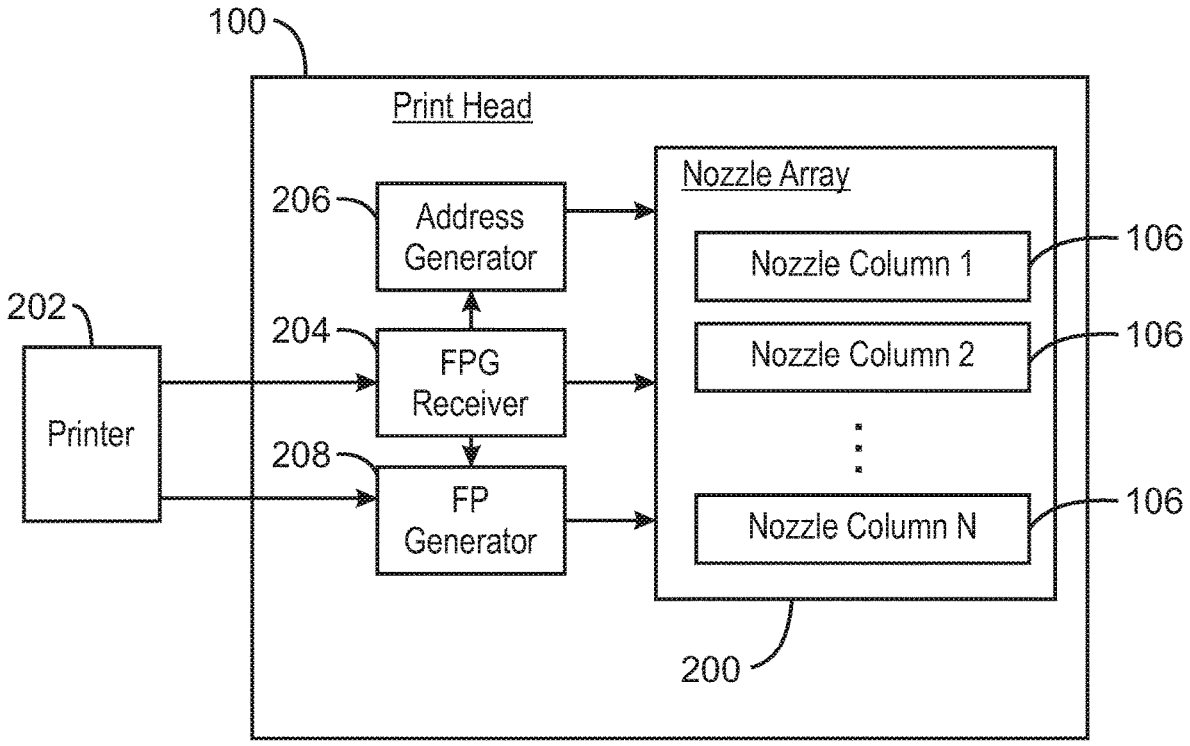
FIG. 2 is a block diagram of an example of drive circuity that can be used to control the printhead.

FIG. 2 is a block diagram of an example of drive circuity that can be used to control the printhead. The printhead of FIG. 2 includes N nozzle columns 106, which are shown as part of a nozzle array 200. The printhead may be installed in a printer 202 and configured to receive print commands from the printer 202 through one or more electrical contacts. Print commands may be sent from the printer 202 to the printhead 100 in the form of a data packet referred to herein as a Fire Pulse Group (FPG). The fire pulse group may be received on the printhead by a controller, referred to as the FPG receiver 204. A fire pulse group can include FPG start bits, which are used by the printhead 100 to recognize the start of a fire pulse group, and FPG stop bits, which indicate the end of packet transmission. The fire pulse group can also include a set of address bits for each nozzle column 106. The address supplied to a primitive partly determines which drive transistor or transistors within a primitive are activated, ultimately resulting in fluid ejection. In some examples, the address bits are included in the fire pulse group, and the FPG receiver 204 sends the address bits to the appropriate nozzle columns 200. In some examples, the address bits are not included in the fire pulse group and are instead generated on the printhead 100. If the address bits are not included in the fire pulse group, the FPG receiver 204 can send the addressing data to an address generator block 206. The address generator block 206 generates the address bits and sends the address bits to the appropriate nozzle columns 200. In some examples, all primitives within nozzle column 106 use the same address data.

The fire pulse group can also include one or more bits of firing data for each primitive 112 (FIG. 1), referred to herein as primitive data. The primitive data is sent from the FPG receiver 204 to each primitive 112. The primitive data determines whether the nozzle that is identified by the address bits within a particular primitive 112 is activated. The primitive data may be different for each primitive 112.

The fire pulse group can also include pulse data, which controls the characteristics of the current pulses delivered to the resistors 108, such as pulse width, number of pulses, duty cycle, and the like. The fire pulse group can send the pulse data to a firing pulse generator 208, which generates a firing signal based on the pulse data and delivers the firing signal to the nozzle columns 106. Once the fire pulse group has been loaded, the fire pulse generator 208 will send the firing signal to the nozzle columns 106, which causes the addressed nozzles to be activated and eject fluid. A particular nozzle within a primitive will be activated when the primitive data loaded into that primitive indicates firing should occur, the address conveyed to the primitive matches a nozzle address in the primitive, and a fire signal is received by the primitive. The drive circuit that can be used to implement this process is described further in relation to FIGS. 3 and 4.

The fire pulse group can also include data that indicates whether drive transistors are to be activated using normal mode or dual mode. During normal mode, only one drive transistor is activated, as determined by the address bits. During dual mode, both drive transistors associated with a nozzle can be activated at the same time, depending on the address bits. The dual mode can be used to activate a boost mode of operation as described above. Additional modes are also possible, including simultaneous micro-recirculation, which is discussed further in relation to FIG. 4. One example of an addressing circuit used to process the information included in the fire pulse group is shown in FIGS. 3A and 3B.

It will be appreciated that the block diagram of FIG. 2 is one example of a printhead 100 that can be manufactured in accordance with the techniques described herein and that several variations may be possible within the scope of the claims. For example, one or more components of the printhead 100, such as the address generator 206 and the fire pulse generator 208, may be separate from the printhead 100. Furthermore, the printhead 100 can be used in any suitable type of precision dispensing device, including a two-dimensional printer, three-dimensional printer, and a digital titration device, among others. Examples of two-dimensional printing technology include thermal ink jet (TIJ) technology, and piezoelectric ink jet technology, among others.

Figure 3A:
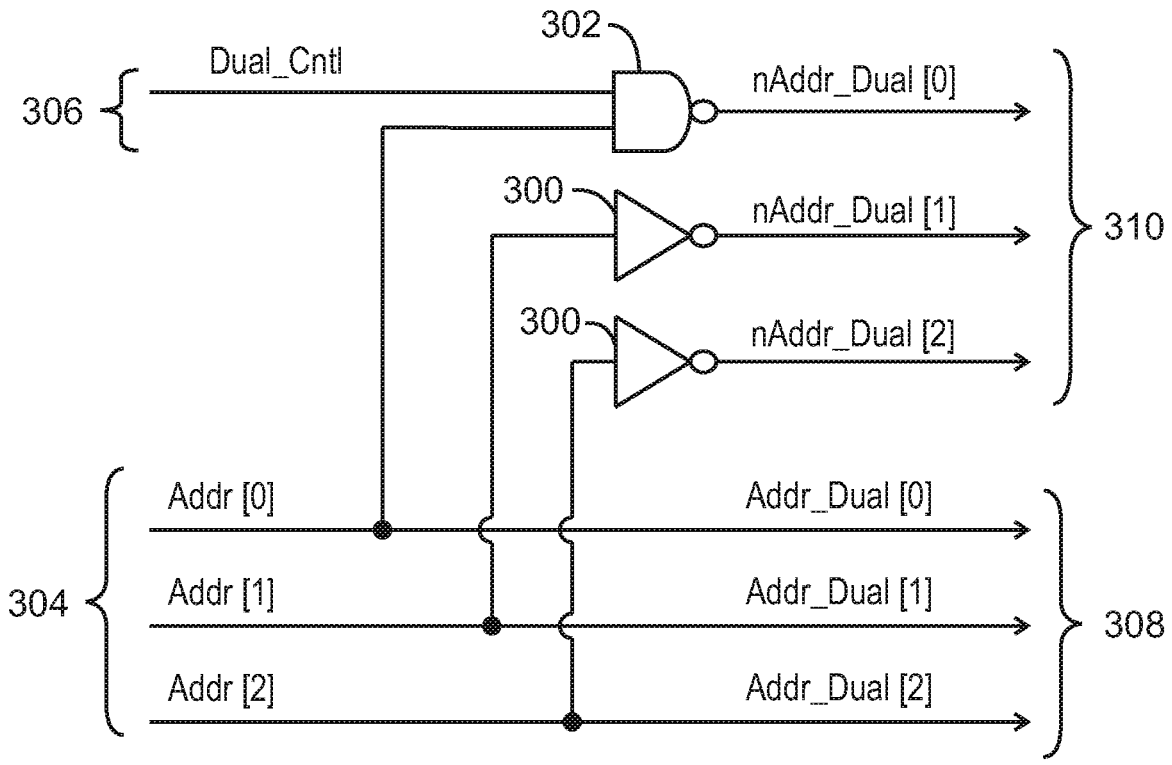
FIGS. 3A and 3B are diagrams showing an example of an addressing circuit that can implement normal mode or dual mode nozzle activation.
Figure 3B:
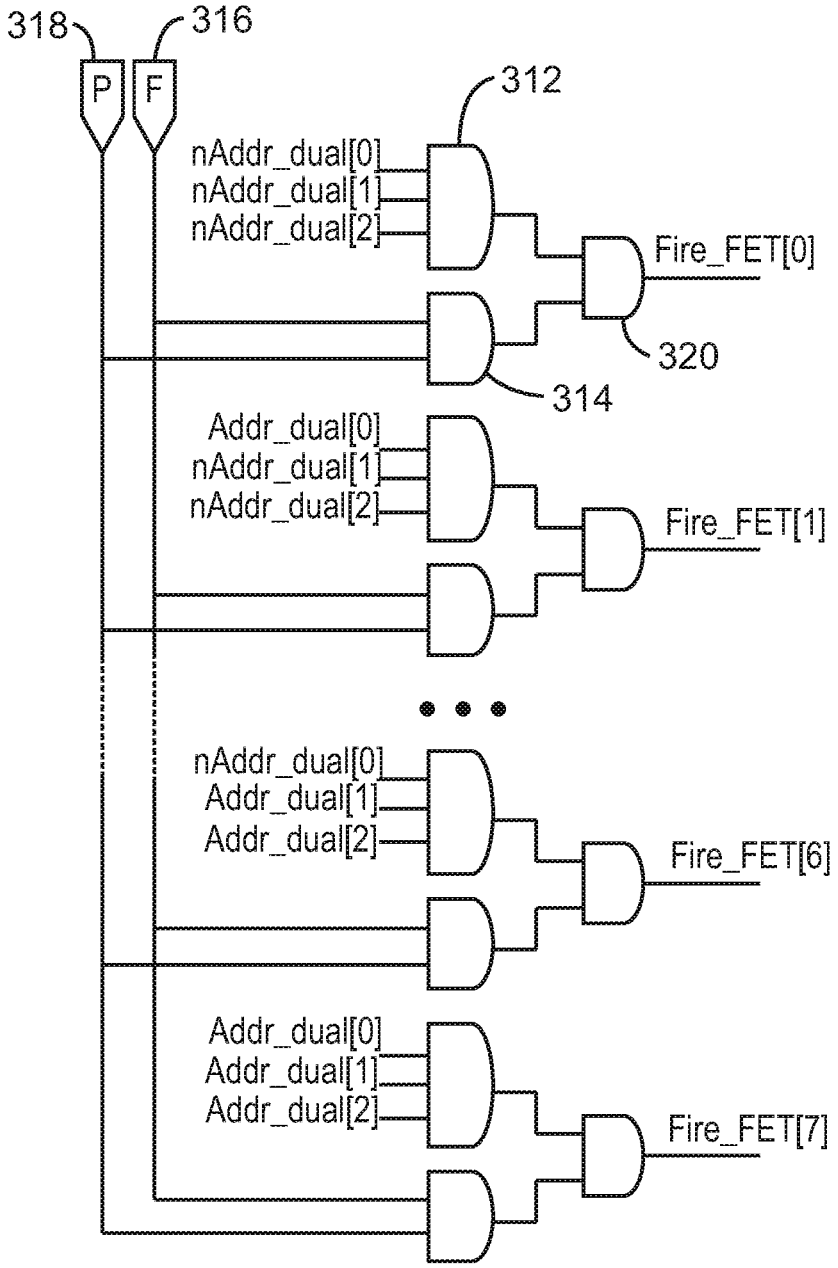

FIG. 3A shows a portion of an addressing circuit that can implement normal mode or dual mode nozzle activation. The addressing circuit 300 may be fabricated in a semiconductor layer, which can include the drive transistors 110 shown in FIG. 1 and the logic components for controlling the firing of the drive transistors 110. The drive transistors are activated by a network of logic components that receive and process the address bits and other drive data. The portion of the addressing circuit shown in FIG. 3A includes two inverters 300 and a NAND gate 302. The addressing circuit also includes an address input 304, a mode input 306, a non-inverted output 308, and an inverted output 310. The address input 304 receives the address bits, Addr[0], Addr [1], and Addr[2] from FPG receiver 204 or the address generator 206 (FIG. 2). The mode input 306, dual_cntl, indicates whether drive transistors are to be activated using normal mode or dual mode. The mode input 306 may also be received from the FPG receiver 204.

The non-inverted output 308 outputs the non-inverted version of the address bits received at the address input 304. During normal mode, the inverted output 310 outputs the inverted versions of the address bits received at the input 304. More specifically, the outputs nAddr_dual [1] and nAddr_dual [2] are always inverted, and the output nAddr_dual [0] is inverted if dual_control equals one, which indicates normal mode operation. Thus, if dual_control equals one, the addressing circuit 300 is equivalent to an addressing circuit in which the NAND gate 302 is replaced by a simple inverter. However, if dual_control is equal to zero (which indicates dual mode), the output nAddr_dual [0] is equal to zero regardless of the value of Addr[0].

The inverted outputs 310 and non-inverted outputs 308 can be sent to the primitives of each nozzle column. Each primitive includes logic that uses the inverted outputs 310 and non-inverted outputs 308 to determine which drive transistors are being addressed by the address bits and the mode input, as shown in FIG. 3B.

FIG. 3B shows a portion of an addressing circuit that can implement normal mode or dual mode nozzle activation. FIG. 3B shows the selection circuitry for a single primitive 112. As shown in FIG. 3, the inverted outputs 310 and non-inverted outputs 308 are routed to a set of AND gates 312. The output of each AND gate 312 is referred to as the "address selection signal" and is a single binary bit that indicates whether the associated nozzle is selected for activation.

The firing signal 316 and the primitive data 318 are input to another AND gate 314. The address selection signal and the output of the AND gate 314 are sent to AND gate 320. The output of the AND gate 320, Fire_FET[n], is coupled to the gate of one of the drive transistors 110. For example, with reference to FIG. 1, the output labeled Fire_FET[0] may be control the drive transistor 110 at Address 0, the output labeled Fire_FET[1] may be control the drive transistor 110 at Address 1, and so on.

In normal mode, each unique combination of address bits 300 will cause the output of only one of the AND gates 312 to output a logic one. For example, during normal mode, the address bits [000] will activate the drive transistor at address 0, address bits [001] will activate the drive transistor at address 1, and so on. In dual mode, some combinations of address bits will cause the output of two of the AND gates 312 to output a logic one. For example, in dual mode, the address bits [000] will activate the drive transistor at address 0, and address bits [001] will activate both of the drive transistors at address 0 and address 1. The complete addressing functionality of the example address circuit of FIGS. 3A and 3B is shown in Table 1 below.

TABLE 1

Dual-mode and Normal-mode Functionality of an Example Addressing circuit.

| Dual_cntl | Address Sent to Primitive (Decimal) | Addr[2:0] | nAddr_dual[2:0] | Drive Transistor Activated | |
|---|---|---|---|---|---|
| 0 | 0 | 000 | 111 | 0 | Dual Mode |
| 0 | 1 | 001 | 111 | 0 & 1 | |
| 0 | 2 | 010 | 101 | 2 | |
| 0 | 3 | 011 | 101 | 2 & 3 | |
| 0 | 4 | 100 | 011 | 4 | |
| 0 | 5 | 101 | 011 | 4 & 5 | |
| 0 | 6 | 110 | 001 | 6 | |
| 0 | 7 | 111 | 001 | 6 & 7 | |
| 1 | 0 | 000 | 111 | 0 | Normal Mode |
| 1 | 1 | 001 | 110 | 1 | |
| 1 | 2 | 010 | 101 | 2 | |
| 1 | 3 | 011 | 100 | 3 | |
| 1 | 4 | 100 | 011 | 4 | |
| 1 | 5 | 101 | 010 | 5 | |
| 1 | 6 | 110 | 001 | 6 | |
| 1 | 7 | 111 | 000 | 7 | |

From Table 1 above, it can be seen that when dual_cntl equals one, each unique combination of address bits will activate a single unique drive transistor. When dual_cntl equals zero, even addresses will activate a single drive transistor, and odd addresses will activate both the odd-address drive transistor and its even-address neighbor simultaneously.

Thus, to energize only the resistor at Address 0, the printer can send an address of 0 to the printhead with the activation mode set to normal mode. To simultaneously energize the resistors at Address 0 and Address 1, the printer can send an address of 1 to the printhead and set the activation mode to dual mode. To energize only the resistor at Address 1, the printer can send an address of 1 to the printhead with the activation mode set to normal mode. Therefore a printer can real-time select between firing a single resistor per nozzle or two resistors through manipulation and control of dual_cntl and the addresses sent to the primitives.

Note that the implementation shown above is just one example of an addressing circuit that can be used to achieve dynamic control of one or more energized drive transistors per nozzle. For example, the logic components of FIG. 3 are shown as a set of AND gates. However, the logic components may be implemented as any suitable combination of electronic devices, such as AND gates, OR gates, inverters, flip-flops, and diodes, among others. It will be appreciated that the drive circuit can include additional components not shown in FIG. 3. Additionally, the boost mode and simultaneous micro-recirculation are just two possible applications of the functionality described here.

Figure 4:
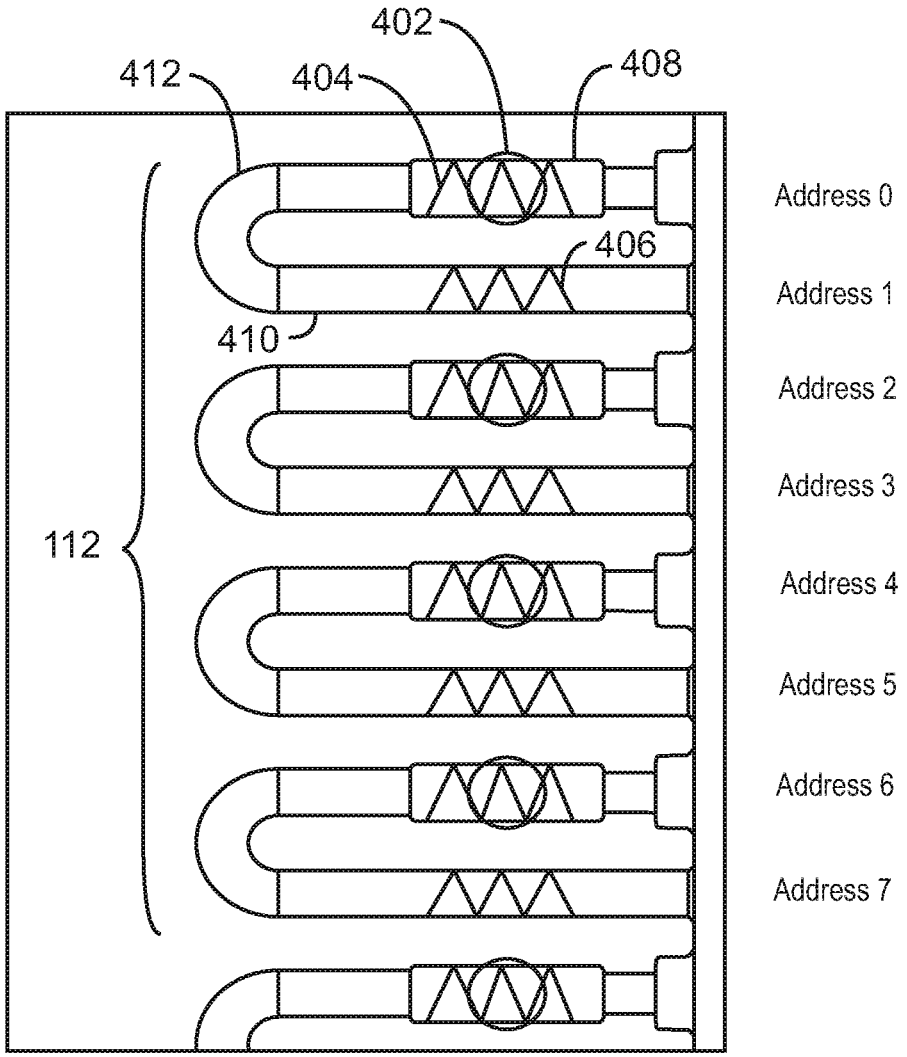
FIG. 4 is a showing a nozzle configuration for implementing simultaneous micro-recirculation.

FIG. 4 is a diagram of a printhead configured for simultaneous micro-recirculation. FIG. 4 shows a single primitive 112 of a printhead 400. The primitive 112 includes four fluid ejection nozzle orifices 402. Each nozzle orifice 402 is associated with two energy delivery devices, a primary resistor 404 and a micro-recirculation resistor 406. The primary resistor 404 may be physically situated in the primary nozzle chamber 408 under the nozzle 402. The micro-recirculation resistor 406 may be in a secondary micro-recirculation chamber 410, which is fluidically coupled to the primary nozzle chamber 408 through a fluidic channel 412. At times, if a nozzle has not fired for a certain period of time, colorant in the fluid may have settled. Micro-recirculation is used to stir the fluid so that colorant in the chamber is properly distributed. In normal mode operation, only the primary resistor 404 is energized. If the nozzle has not been fired for a certain duration, dual mode can be specified so that both the primary resistor 404 and micro-recirculation resistor 406 will fire simultaneously. The primary resistor 404 may be coupled to the drive transistor 110 associated with Address 0, and the micro-recirculation resistor 406 may be coupled to the drive transistor 110 associated with Address 1. The addressing circuit 300 of FIGS. 3A and 3B can be used to control whether one or both of the resistors for a particular nozzle are activated.

Figure 5:
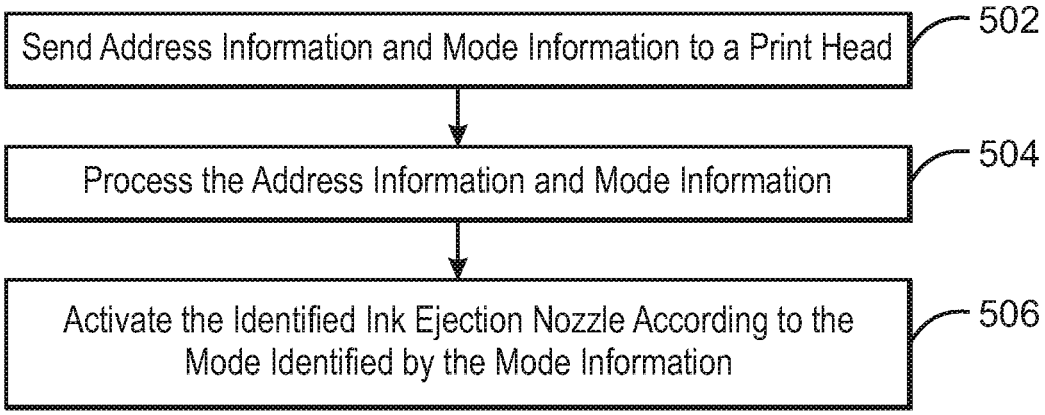
FIG. 5 is a process flow diagram for a method of operating a printhead.

FIG. 5 is a process flow diagram for a method of operating a printhead. The method 500 may be performed by a printer comprising a printhead, such as the printer 202 and the printhead 100 shown in FIG. 2.

At block 502, the printer sends address information and mode information to the printhead. The mode information may indicate a normal mode or a dual mode, such as the boost mode or micro-recirculation mode discussed above. The address information can uniquely identify a particular fluid ejection nozzle within each primitive. The nozzle can include a plurality of energy delivery device. In some examples, the address information comprises a set of address bits or is converted to a set of address bits.

At block 504, the printhead processes the address information and the mode information using logic included in the printhead, such as the addressing circuit 300 of FIGS. 3A and 3B. The logic can include active and passive components, including inverters, diodes, operation amplifiers, flip-flops, and Boolean logic operators such as AND gates, NAND gates, OR gates, among others. The logic may be fabricated in a semiconductor as an integrated circuit. The output of the logic determines which energy delivery device are activated. Processing the address information and mode information can include inputting the mode information and one of the set of address bits to a NAND gate as shown in FIG. 3A.

At block 506, the identified fluid ejection nozzle is activated. A combination of the address information and the mode information determines how many energy delivery device of the fluid ejection nozzle are energized. Based on the mode information, normal mode or dual mode may be activated. Dual mode can be a boost mode, a simultaneous micro-recirculation mode, or any other mode in which more than one heating element is energized. In some examples, the fluid ejection nozzle includes a first heating element and a second heating element. If the mode information specifies normal mode, then either the first heating element or the second heating element is activated depending on the address information. If the mode information species a dual mode, both the first resistor and the second resistor can be activated, depending on the address information.

The process flow diagram of FIG. 5 is not intended to indicate that the operations of the method 500 are to be executed in any particular order, or that all of the operations of the method 500 are to be included in every case. Additionally, the method 500 can include any suitable number of additional operations.

Figure 6:
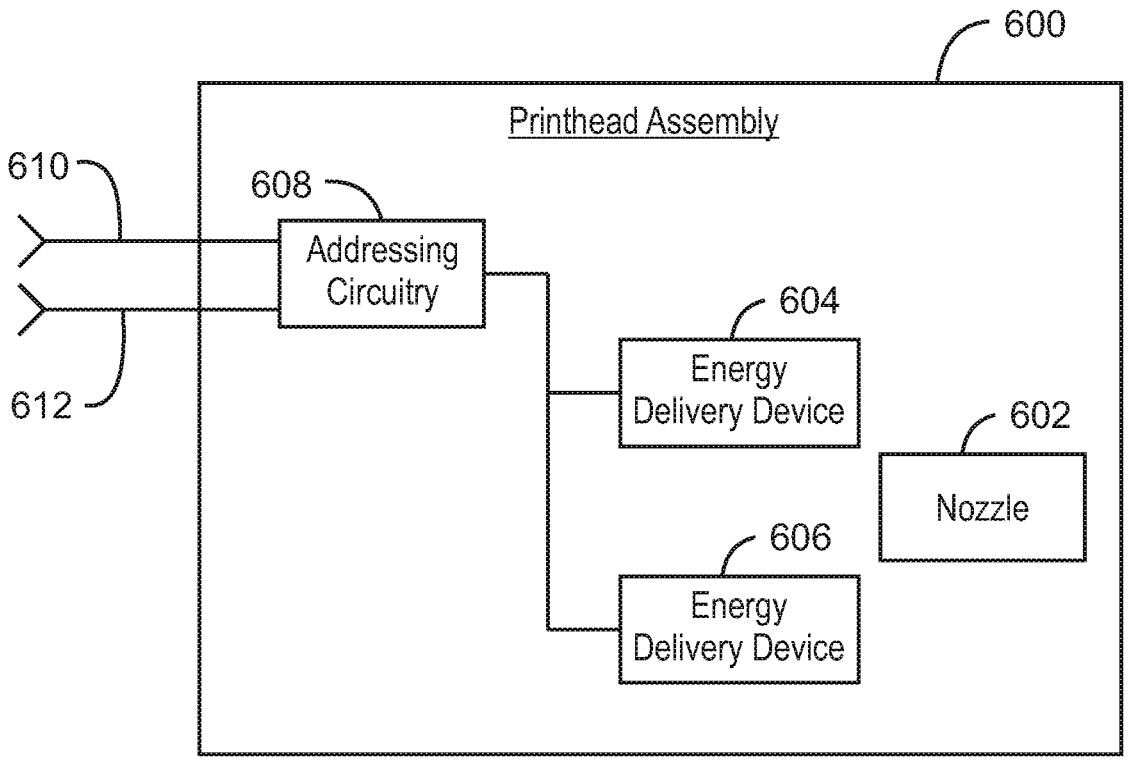
FIG. 6 is a simplified block diagram showing an example of a printhead assembly that supports normal mode and dual mode operation.

FIG. 6 is a simplified block diagram showing an example of a printhead assembly that supports normal mode and dual mode operation. The printhead assembly 600 includes a fluid ejection nozzle 602, a first energy delivery device 604 fluidically coupled to the fluid ejection nozzle 602, and a second energy delivery device 606 fluidically coupled to the fluid ejection nozzle 602. The printhead assembly 600 can also include additional fluid ejection nozzles with corresponding first and second energy delivery devices, which are not shown in FIG. 6. In some examples, the energy delivery devices 604 and 606 are resistors. The printhead assembly 600 also includes addressing circuitry 608 to activate the fluid ejection nozzle 602. The addressing circuitry 608 receives a nozzle address 610 and an activation mode 612 as inputs. The nozzle address 610 selects the nozzle 602 for activation and the activation mode 612 determines which of the first energy delivery device 604 and the second energy delivery device 606 are to be energized. In some examples, only one of the energy delivery devices 604 or 606 is energized. In some examples, both the first energy delivery device 604 and the second energy delivery device 606 are energized.

In some examples, such as the boost mode examples described above, the first energy delivery device 604 and the second energy delivery device 606 are both fluidically coupled to a same fluid chamber comprising the fluid ejection nozzle 602. In some examples, the first energy delivery device 604 is included a primary fluid chamber and the second energy delivery device 606 is included in a micro-recirculation chamber.

The present examples may be susceptible to various modifications and alternative forms and have been shown only for illustrative purposes. Furthermore, it is to be understood that the present techniques are not intended to be limited to the particular examples disclosed herein. Indeed, the scope of the appended claims is deemed to include all alternatives, modifications, and equivalents that are apparent to persons skilled in the art to which the disclosed subject matter pertains.

What is claimed is:

1. A method comprising:

sending address information and a mode indication to a printhead, wherein the address information identifies a fluid ejection nozzle comprising a plurality of energy delivery devices including a first heating element and a second heating element;

processing the address information and the mode indication using a logic gate included in the printhead, the logic gate to output a plurality of output address bits corresponding to a plurality of input address bits in the address information; and activating the identified fluid ejection nozzle, wherein based on a combination of a value of the address information and a value of the mode indication received by the logic gate, the logic gate determines how many energy delivery devices of the identified fluid ejection nozzle are energized based on:

when the mode indication is set to a first value:

changing, by the logic gate, a value of a first output address bit of the plurality of output address bits in response to a change in value of a first input address bit of the plurality of input address bits, and activating, by the logic gate, one of the first heating element and the second heating element depending on the value of the address information, and when the mode indication is set to a second value different from the first value:

setting, by the logic gate, the first output address bit to a same value regardless of the value of the first input address bit, and activating, by the logic gate, both the first heating element and the second heating element depending on the value of the address information.

2. The method of claim 1, wherein the activating of the identified fluid ejection nozzle comprises activating a boost mode based on the mode indication.

3. The method of claim 1, wherein the mode indication is set to the first value to indicate a normal mode, and set to the second value to indicate a dual mode.

4. The method of claim 1, wherein the logic gate comprises a NAND gate to receive the mode indication and the first input address bit, and the NAND gate is to output the first output address bit responsive to the mode indication and the first input address bit.

5. The method of claim 1, wherein the mode indication comprises a mode signal.

6. The method of claim 1, wherein the first input address bit is a least significant bit of the address information.

7. The method of claim 1, further comprising controlling, using the plurality of output address bits produced by the logic gate, transistors that control activation of the plurality of energy delivery devices.

8. The method of claim 7, comprising producing, by the logic gate, a second output address bit of the plurality of output address bits as an inversion of a second input address bit of the plurality of input address bits.

9. The method of claim 1, wherein when the mode indication is set to the second value, the logic gate maintains the first output address bit to the same value when the first input address bit changes from one state to another state.

10. A method comprising:

sending address information and a mode indication to a printhead, wherein the address information identifies a fluid ejection nozzle comprising a plurality of energy delivery devices;

processing the address information and the mode indication using a logic gate included in the printhead, the logic gate to output a plurality of output address bits corresponding to a plurality of input address bits in the address information; and activating the identified fluid ejection nozzle, wherein based on a combination of a value of the address information and a value of the mode indication received by the logic gate, the logic gate determines how many energy delivery devices of the identified fluid ejection nozzle are energized based on:

when the mode indication is set to a first value, changing, by the logic gate, a value of a first output address bit of the plurality of output address bits in response to a change in value of a first input address bit of the plurality of input address bits, and when the mode indication is set to a second value different from the first value, setting, by the logic gate, the first output address bit to a same value regardless of the value of the first input address bit, wherein the activating of the identified fluid ejection nozzle comprises activating a simultaneous micro-recirculation mode based on the mode indication.

11. The method of claim 10, wherein the plurality of energy delivery devices comprise a first heating element and a second heating element, the method comprising:

when the mode indication is set to the first value, activating, by the logic gate, one of the first heating element and the second heating element depending on the value of the address information; and when the mode indication is set to the second value, activating, by the logic gate, both the first heating element and the second heating element depending on the value of the address information.

12. The method of claim 10, further comprising controlling, using the plurality of output address bits produced by the logic gate, transistors that control activation of the plurality of energy delivery devices.

13. The method of claim 12, comprising producing, by the logic gate, a second output address bit of the plurality of output address bits as an inversion of a second input address bit of the plurality of input address bits.

14. A method comprising:

selectively activating a plurality of fluid ejection nozzles, each fluid ejection nozzle coupled to a first energy delivery device and a second energy delivery device, wherein the selective activating comprises:

receiving, by a logic gate, a plurality of input address bits of a nozzle address and an activation mode signal to selectively energize, for a first fluid ejection nozzle of the plurality of fluid ejection nozzles, one or both of the first energy delivery device and the second energy delivery device for the first fluid ejection nozzle based on a combination of a value of the nozzle address and a state of the activation mode signal, outputting, by the logic gate, a plurality of output address bits corresponding to the plurality of input address bits, wherein when the activation mode signal is set to a first state, the logic gate changes a value of a first output address bit of the plurality of output address bits in response to a change in value of a first input address bit of the plurality of input address bits, and wherein when the activation mode signal is set to a second state different from the first state, the logic gate sets the first output address bit to a same value regardless of the value of the first input address bit, and wherein the activation mode signal is set to the first state to select a normal mode of operation, and set to the second state to select a boost mode of operation.

15. The method of claim 14, comprising:

energizing, by the logic gate, one of the first energy delivery device and the second energy delivery device for the first fluid ejection nozzle in response to the value of the nozzle address and the activation mode signal being set to the first state; and energizing, by the logic gate, both the first energy delivery device and the second energy delivery device for the first fluid ejection nozzle in response to the value of the nozzle address and the activation mode signal being set to the second state.

16. The method of claim 14, wherein the first input address bit is a least significant bit of the nozzle address.

17. The method of claim 14, further comprising controlling, using the plurality of output address bits produced by the logic gate, transistors that control activation of the first and second energy delivery devices for the first fluid ejection nozzle.

18. The method of claim 17, comprising producing, by the logic gate, a second output address bit of the plurality of output address bits as an inversion of a second input address bit of the plurality of input address bits.

19. The method of claim 14, wherein when the activation mode signal is set to the second state, the logic gate maintains the first output address bit to the same value when the first input address bit changes from one state to another state.

* * * * *